United States Patent [19]

Ballu

[11] Patent Number: 4,881,687

[45] Date of Patent: Nov. 21, 1989

[54] PORTABLE LIQUID SPRAYER, PARTICULARLY FOR THE TREATMENT OF PLANTS

[75] Inventor: Patrick J. M. Ballu, Reims, France

[73] Assignee: Tecnoma, Epernay, France

[21] Appl. No.: 209,197

[22] Filed: Jun. 20, 1988

[30] Foreign Application Priority Data

Jun. 29, 1987 [FR] France ..... 87 09126

[51] Int. Cl.[4] ..... B05B 9/043

[52] U.S. Cl. ..... 239/332; 239/333; 417/238; 222/385

[58] Field of Search ..... 417/118, 374, 149, 238; 239/332, 330, 600, 324, 152–154, 333; 222/385, 397, 175, 626, 628

[56] References Cited

U.S. PATENT DOCUMENTS

| | | | |
|---|---|---|---|
| 3,709,409 | 1/1973 | Collins | 239/373 X |
| 3,901,449 | 8/1975 | Bochmann | 239/587 X |
| 4,192,464 | 3/1980 | Chow | 239/373 |
| 4,214,146 | 7/1988 | Schimanski | 239/57 X |
| 4,384,675 | 5/1983 | Jacobs | 239/373 X |
| 4,651,903 | 3/1987 | Pagliai | 239/332 X |

FOREIGN PATENT DOCUMENTS

| | | |
|---|---|---|
| 2055868 | 5/1972 | Fed. Rep. of Germany . |
| 1221656 | 1/1962 | France . |

*Primary Examiner*—Andres Kashnikow
*Assistant Examiner*—Kevin P. Weldon
*Attorney, Agent, or Firm*—Watson, Cole, Grindle & Watson

[57] ABSTRACT

A portable sprayer has a container is provided with a threaded hole for selectively mounting to either a hand pump which pressurizes the interior of the container or an electric pump, which may be operated by batteries or a rechargeable accumulator, which delivers the liquid to the sprayer without pressurizing the container. The container is provided with another threaded hole for filling purposes. This hole can be closed by a leak-tight stopper, which is equipped with a valve or a pressure gauge if the hand pump is used, or by a simpler stopper if the electric pump is used.

8 Claims, 4 Drawing Sheets

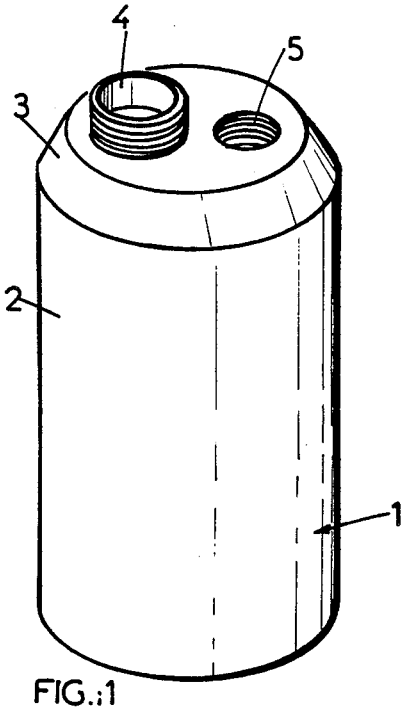
FIG.:1
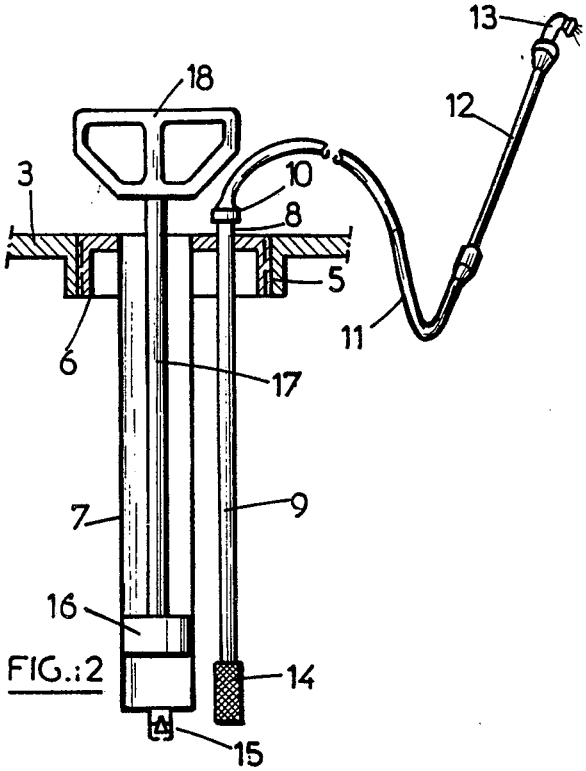
FIG.:2
FIG.: 3
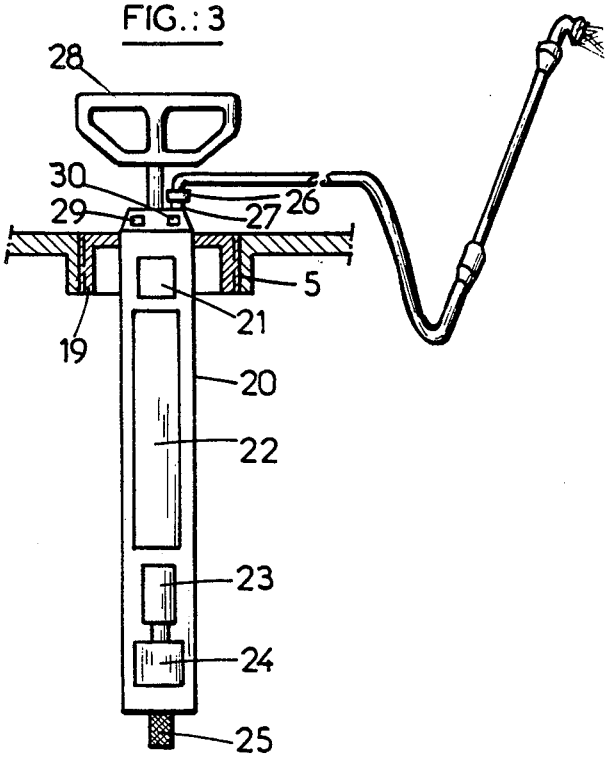

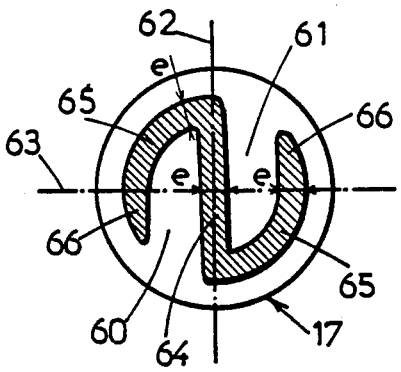
FIG.: 11
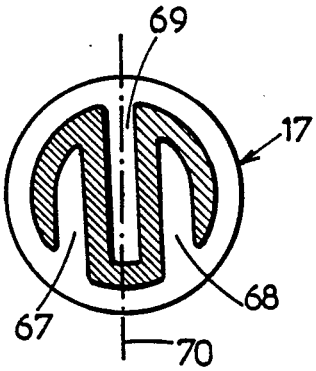
FIG.:12
FIG.: 13
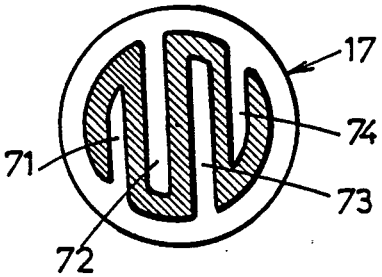

PORTABLE LIQUID SPRAYER, PARTICULARLY FOR THE TREATMENT OF PLANTS

The present invention relates to a portable liquid sprayer, particularly for the treatment of plants.

In the case of small areas or difficult locations plants are usually treated by spraying with liquid with the aid of portable sprayers comprising a container which can be carried on the operator's back and is capable of containing a suitable liquid, a lance connected to the container by a flexible tube, and means for pressurizing the liquid in the container and delivering it through the tube to the lance.

The simplest and least expensive model comprises a leaktightly sealed reservoir equipped with a hand pump, which may be a simple piston pump, and which pressurizes the air contained in the reservoir above the level of the liquid. After having pressurized the reservoir, the operator sprays liquid through the lance until the pressure falls to an insufficient level. He then simply needs to operate the pump again to continue spraying.

An improved and therefore more expensive model has a liquid pump interposed between the container and the tube and operated by an electric motor. This pump takes liquid from the container, pressurizes it and delivers it through the tube to the lance. The reservoir therefore does not need to be leaktightly sealed.

The electric motor may be fed either by means of a flexible lead or by a portable energy source, such as batteries or rechargeable accumulators.

Depending on circumstances, the user may prefer one or the other of these models. It is therefore preferable for a shopkeeper to keep in stock a sufficient quantity of sprayers of both types. Since in addition reservoirs of various capacities are available, the shopkeeper must keep a stock which takes up considerable space but has a fairly low unitary commercial value, thus increasing his cost prices. A first object of the invention is to provide a system which will enable shopkeepers to keep stocks of both types of sprayers in a total storage space smaller than that required under present conditions.

A second object of the invention is to provide a sprayer whose cost price is also reduced in comparison with present techniques, while a good appearance is retained.

In order to achieve these results, the invention provides a sprayer comprising a container capable of containing a liquid, a lance connected to the container by a flexible tube, and detachable means for pressurizing the liquid in the container and delivering it into the tube, this sprayer having the following features:

Two means are provided for pressurizing the liquid and delivering it into the tube, these means being able to be used alternately in place of one another and one of such means comprising a hand pump capable of pressurizing the interior of the container, and means for sealingly fastening the pump in the container, while the other means comprises an electric pump capable of taking liquid from the container and delivering it under pressure into the tube, and means for fastening the pump in the container.

The reservoir is capable of withstanding the pressure generated by the hand pump.

The electric pump is preferably provided with an electric motor operated by batteries or a rechargeable accumulator.

As will readily be understood, because of the arrangement according to the invention a shopkeeper will now need to keep in stock only a single set of reservoirs corresponding to the different capacities available and sets of interchangeable hand pumps or electric pumps, which will take up far less space. The saving in respect of storage space required is therefore of the order of 50%.

In addition to an aperture into which the hand pump is inserted, the container associated with a hand pump usually has a pressure gauge or a vent valve and sometimes a second aperture for filling, closable by a leaktight stopper. In certain constructions the pressure gauge or vent valve is mounted on the filling aperture stopper. In a preferred embodiment of the invention a stopper capable of leaktight closure and equipped with a pressure gauge or a vent valve is associated with the hand pump, whereas a stopper not equipped with a pressure gauge or vent valve, but preferably having a vent hole to allow air to enter the container, is associated with the electric pump. As the result of this arrangement, the cost price of the arrangement using the electric pump is reduced because the corresponding filling stopper can be very inexpensive. The changeover from one version to the other is however easy. The arrangement using a hand pump can nevertheless be improved from the point of view of safety by providing for the stopper associated with the hand pump to be a screw stopper and to be equipped with a vent valve and with means ensuring that this valve is obligatorily operated before the stopper is unscrewed.

In one advantageous form of this embodiment the vent vale is provided with a spring loaded piston moving in a cylinder which at the bottom leads into the interior of the container and at the top is provided with a vent widening, the stopper being equipped with a cap surrounding it and connected to it by a helical cam and the cap being provided with means for displacing said piston in the upward direction, in such a manner that when the cap is turned in the unscrewing direction it first raises the piston to vent the container before turning the stopper in order to unscrew it.

According to another advantageous form of the same embodiment, which is still less expensive than the previous form, provision is made for the vent valve to comprise a spring loaded piston moving in a cylinder which at the bottom leads into the interior of the container and is provided, likewise at the bottom, with a vent widening, the piston rod carrying a cap which covers a substantial part of the top surface, while the stopper is a screw stopper which, in order to be unscrewed, requires that a considerable downward force must first be exerted on it, which force can be exerted only by pressure on the valve rod cap, which entails the venting of the container.

For the same quality and standard of safety, these forms make it possible to reduce the cost price of the hand pump version. Another form makes it possible to reduce this cost price still further. It consists in providing, when the hand pump is a piston pump, for the piston rod to be a casting whose crosssection has an external contour of circular shape and which is provided with two or more longitudinal grooves parallel to one another and of sufficient depth to extend beyond the axial plane at right angles to their transverse direction.

It is known that casting makes it possible to produce parts of good quality at a very low cost price. It is known to produce piston rods of cruciform section by this method, in order to save material in comparison with a solid circular section. In the case of a pump piston rod this shape does not provided suitable guidance, so that excessive wear is caused. The arrangement just described enables this disadvantage to be avoided without substantial increase of cost.

The invention will now be described in greater detail, with the aid of practical examples illustrated in the drawings, in which:

FIG. 1 is a simplified view in perspective of the container.

FIG. 2 is a schematic section of the hand pump.

FIG. 3 is a schematic section of the electric pump.

FIGS. 11 to 13 show three preferred variants of the section of the hand pump piston rod.

Figure 4:
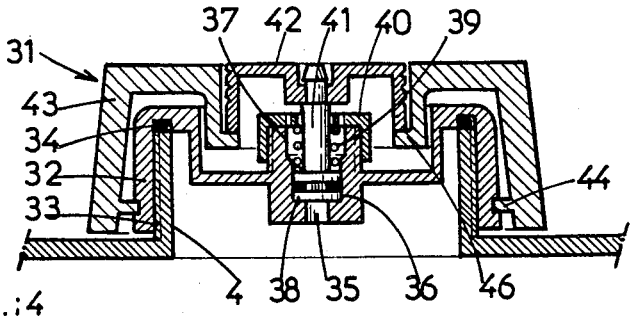
FIGS. 4 to 6 are schematic sections of a stopper having a built-in safety valve and automatic venting before unscrewing, in three positions.

FIG. 1 shows a reservoir 1 comprising a lower container 2 of transparent plastics material, to which is welded a top part 3 of more rigid plastics material, which is provided with two apertures 4 and 5 each having a screwthread, which may be either an internal or an external thread.

FIG. 2 shows a schematic section of the hand pump in its preferred form. A base 6 provided with a screwthread is intended to be mounted in the hole 5. It carries the hand pump cylinder 7 and the outlet 8 of a liquid discharge tube 9. This outlet 8 is provided with a nipple 10 for connection to the flexible tube 11 leading to the lance 12, which ends in a nozzle 13. The other end of the tube 9 is provided with a filter 14. An expulsion valve 15 is shown at the bottom end of the pump cylinder 7. The pump piston 16 is connected by a rod 17 to a handle 18 which serves to operate it in the vertical direction.

FIG. 3 shows the section of the preferred form of the electric pump. A threaded base 19 having the same external dimensions as the base 6 of the hand pump is mounted, similarly to said base 6, in the hole 5. It carries a cylindrical casing 20 containing, in succession from top to bottom, a charger 21, a rechargeable battery 22, a pump motor 23, and a pump 24. As a variant, these different components could be disposed in a different order. At its bottom end the casing 20 carries a filter 25 positioned at the pump inlet. This filter is optional. The pump outlet is connected by a tube 26 to a connector 27 identical to the connector 10 in FIG. 2. A handle 28 is mounted on the top end of the casing 20, and serves solely for handling purposes. 29 and 30 designate respectively a switch controlling the motor 23 (which may optionally be fitted on the handle 28) and a plug socket for connecting the charger 21 to the mains for the purpose of charging the battery 22.

If the hole 5 is bounded by an externally screwthreaded projecting collar (a variant not illustrated), the electric pump is fixed in the reservoir 1 by means of a nut which is screwed onto the thread of said collar. This nut may be fastened to the pump or be separate from the latter.

Figure 5:
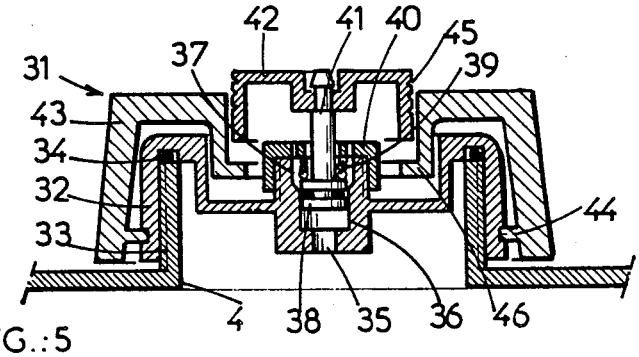
Figure 6:
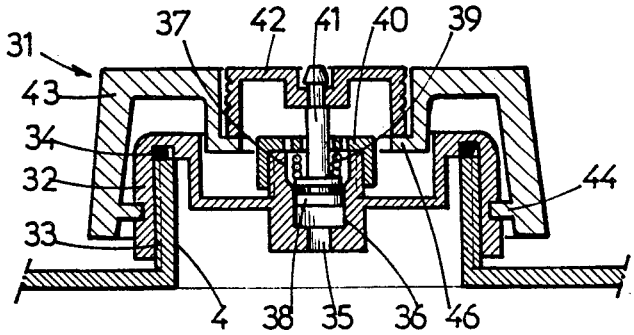

FIGS. 4 to 6 show a stopper 31 intended to close the filling hole 4 of the reservoir in the case of the hand pump version. An inner stopper 32 is screwed onto a screwthread 33 surrounding the hole 4. A seal 34 is placed between the inner stopper 32 and the edge of the hole 4. The central part of the inner stopper 32 has an axial bore consisting of three successive portions: an inner portion 35 of slight diameter, an intermediate portion 36 of larger diameter, and an outer portion 37 of still larger diameter. A piston 38 is adapted to move in the bore. Its diameter is such that it cannot penetrate into the narrow portion 35, that it circulates sealingly without clearance in the intermediate portion 36, and that it allows the free passage of air in the widened portion 37. A compression spring 39 held by a nut 40 pushes the piston 38 in the downward direction. The piston rod 41 carries a cap 42 the purpose of which will be explained further on.

The inner stopper 32 is covered by an outer stopper 43, the connection between the two stoppers being made by means of a helical screw 44 which extends over approximately one quarter turn. The top of the stopper 43 is flat, with a cutout in its central part, this cutout having a diameter slightly greater than that of the cap 42.

In the position of rest, which is shown in FIG. 4, that is to say when there is no pressure in the reservoir, the spring 39 pushes the piston 38 downwards against a shoulder separating the portions 35 and 36 of small and intermediate diameters of the bore. As shown in FIG. 4, in this position the top of the cap 42 is substantially level with the top surface of the outer stopper 43.

FIG. 5 shows the situation when the reservoir is under pressure: the pressure of the reservoir acts on the piston 38 against the action of the spring 39 and raises the piston, together with the cap 42 attached to it, so that the cap projects above the top surface of the outer stopper 43. Graduations 45 marked on the side face of the cap 42 make it possible to judge the extent to which the cap has been raised, and thus to know the pressure inside the reservoir. If this pressure becomes such that the piston 38 reaches the portion 37 of largest diameter of the bore, the seal is no longer effective and air escapes. A safety valve or in other words a pressure limiter is thus formed.

FIG. 6 shows how the depressurization of the reservoir is effected before it is opened. The rotation of the outer stopper 43 on the inner stopper 32 results in the raising of the outer stopper relative to the inner stopper through the action of the helical screw 44. On the sides of the cavity receiving the cap 42 the outer stopper has a rim 46 which passes under the cap 42 and raises the latter, thus raising the piston 38 until it reaches the portion 37 of largest diameter of the bore. At that moment the interior of the reservoir is connected to the atmosphere, and consequently all superatmospheric pressure is eliminated. When the turning of the outer stopper 43 is continued, the end of the helical screw 44 is reached, and from that moment on the inner stopper 32 is also turned and thus unscrewed.

Figure 7:
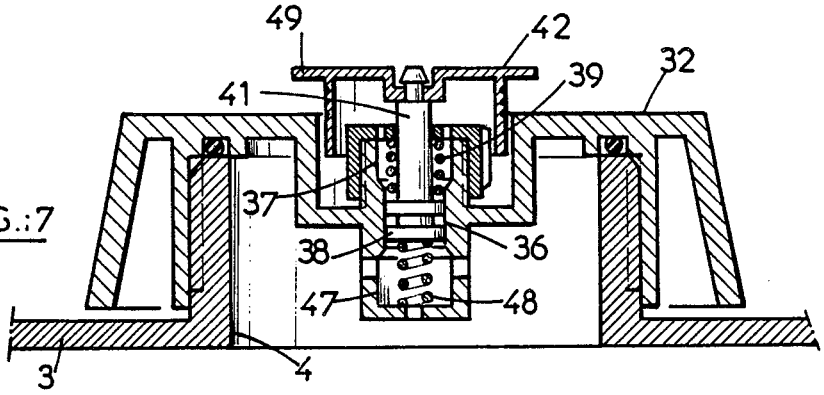
FIGS. 7 to 9 are similar views of a variant of the stopper shown in FIGS. 4 to 6.
Figure 9:
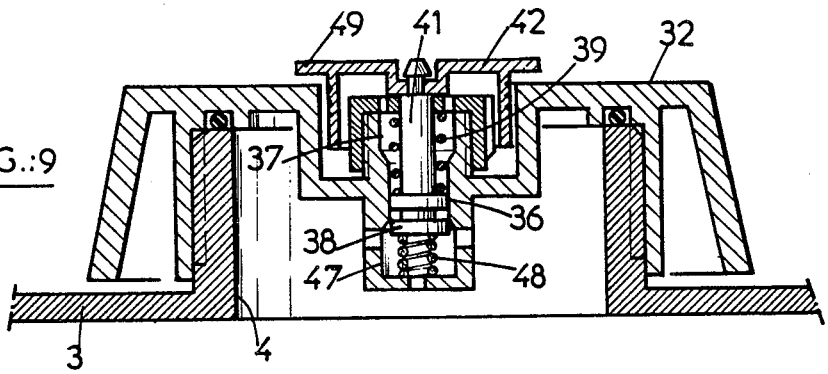
Figure 8:
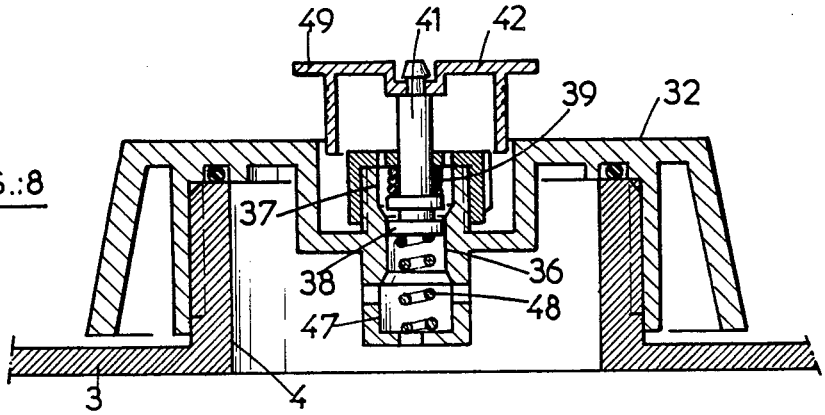

FIGS. 7 to 9 show a variant of the arrangement shown in FIGS. 4 to 6. The same references therein designate similar elements. The inner stopper 32 is retained practically without change, but in the bore the portion 36 of smallest diameter is replaced by a portion 47 of large diameter; in other words, the bore comprises from bottom to top a portion 47 of large diameter, a portion 36 of smaller diameter, this diameter corresponding to that of the piston 38, and again a portion 37 of large diameter. In the position of rest the piston 38 is held in the portion 36 of relatively small diameter through the action of two antagonistic springs 39 and 48 which act one on each side of it. At the top the cap 42 has a collar 49 of large diameter, which extends above the top of the stopper 32. The outer stopper 43 and its helical screw 44 are dispensed with. In the position of rest, shown in FIG. 7, or in the working or venting position, shown in FIG. 8, the functioning is the same as that described in connection with FIGS. 4 and 5. In order to depressurize the reservoir before it is opened, it is now sufficient to apply pressure to the cap 42, or its collar 49, so as to cause the piston 38 to penetrate into the widened bottom part 47 of the bore. Depressurization is thus immediately achieved. The width of the collar is selected to be sufficient large for it to be impossible in practice to unscrew the stopper without applying pressure to the cap. It will be noted that this solution also makes it possible, in case of need, to effect urgent depressurization simply by applying pressure to the cap 42, which for this purpose constitutes a pushbutton.

Figure 10:
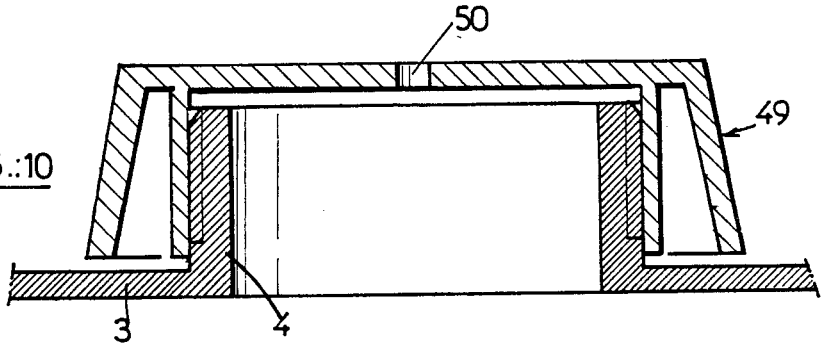
FIG. 10 is a similar view of the stopper associated with the electric pump.

FIG. 10 shows the stopper 49 which is used in the electric pump version. As can be seen, this is a stopper whose outside shape is similar to that of the inner stopper 32 described above, but which is without a multi-diameter bore, a piston or a cap. A vent hole is simply shown at 50. A seal such as 34 is of course not needed in this case. It can be seen that this stopper is an extremely inexpensive component.

FIG. 11 is a cross-section of the piston rod 17 of the hand pump. This section is derived from a solid circular shape by the provision of two wide, deep longitudinal grooves 60, 61 which cut deeply into the rod. In section, these grooves have parallel flanks if the reliefs necessary for the casting process are ignored. The flanks of these grooves are parallel to one another and therefore parallel to a median plane 62 of the section. They extend well beyond the axial plane 63 at right angles to the plane 62 and end only at a distance e from the opposite side of the periphery of the section. The distance between the two grooves is also equal to this distance e, and the width of the grooves is calculated to ensure that the same distance e also exists between the groove and the end of the corresponding perpendicular diameter. An S-shaped general form is thus obtained with a substantially constant section of material. As can be seen in this Figure, the openings of the two grooves, taken together, correspond approximately to one quarter of the periphery of the section. This shape ensures great lightness together with good mechanical strength, and at the same time effective guidance because practically three-quarters of the circular periphery of the rod is retained. If it is desired to describe more fully the shape of the section, it may be considered that it comprises a central core 64 having parallel faces and being substantially parallel to the plane 62. Taking into account the fact that the relief angles are the same, the two faces of the core 64 form in fact with the plane 62 an angle equal to the relief angle, for example 1 degree. At each end the central core is joined to a portion 65 forming an arc of a circle of 90 degrees and having a thickness e equal to that of the central core. Each portion 65 is extended by a terminal portion 66 bounded on one side by an arc of a circle forming the periphery of the rod and on the other side by a plane surface forming that flank of the groove 60 or 61 which lies opposite the central core 64. This terminal portion, the thickness of which thus decreases, extends over about 45 degrees and its end is rounded with a small radius.

FIG. 12 shows a variant of the embodiment illustrated in FIG. 11, wherein there are three grooves 67, 68 and 69, the grooves 67 and 68 being disposed symmetrically one on each side of a plane of symmetry 70, while the groove 69 is coaxial with said plane 69.

FIG. 13 relates to another Variant, in which this time there are four grooves 71, 72, 73 and 74 parallel to one another and opening alternately in opposite directions. The design and construction principles described in connection with FIG. 11 also apply to FIGS. 12 and 13.

It will be observed that in all cases excellent guidance is obtained with a great saving of material because the greater part of the peripheral surface corresponding to a solid circular section is retained. This advantage is accompanied by the ease of production resulting from the casting process and by a satisfactory aesthetic effect.

I claim:

1. Sprayer comprising a container capable of containing a liquid, a lance connected to the container by a flexible tube, and two means for delivering the liquid under pressure into the tube, said means being capable of use alternately in place of one another and one of said means comprising a hand pump capable of pressurizing the interior of the container, and means for sealingly fastening said pump in the container, the other of said delivering means comprising an electric pump capable of taking the liquid from the container and delivering the liquid under pressure into the lance without pressurizing said container, and means for fastening said pump in the container, the container being capable of withstanding the pressure generated by the hand pump.

2. Sprayer according to claim 1, characterized in that the electric pump is provided with an electric motor operated by batteries or a rechargeable accumulator.

3. Sprayer according to claim 1, in which a stopper capable of leaktight closure and equipped with a vent valve is associated with the hand pump, whereas a stopper not equipped with a pressure gauge or vent valve, but having a vent hole to allow air to enter the container, is associated with the electric pump.

4. Sprayer according to claim 3, in which the stopper associated with the hand pump is a screw stopper and is equipped with means ensuring that said vent valve is required to be operated before the stopper is unscrewed.

5. Sprayer according to claim 4, in which said vent valve is provided with a spring loaded piston moving in a cylinder which at the bottom leads into the interior of the container and at the top is provided with a vent widening, the stopper being equipped with a cap surrounding it and connected to it by a helical cam and the cap being provided with means for displacing said piston in the upward direction, in such a manner that when the cap is turned in the unscrewing direction it first raises the piston to vent the container before turning the stopper in order to unscrew it.

6. Sprayer according to claim 4, in which said vent valve comprises a spring loaded piston moving in a cylinder which at the bottom leads into the interior of the container and is provided, likewise at the bottom, with a vent widening, the piston rod carrying a cap which covers a substantial part of the top surface, while the stopper is a screw stopper which, in order to be unscrewed, requires that a considerable downward force must first be exerted on it, which force can be exerted only by pressure on the valve rod cap, which entails the venting of the container.

7. Sprayer according to claim 1, in which the hand pump is a piston pump, having a piston rod in the form of a casting whose cross-section has an external contour of circular shape and which is provided with two or more longitudinal grooves parallel to one another and of sufficient depth to extend beyond the axial plane at right angles to their transverse direction.

8. Sprayer according to claim 1, in which a stopper capable of leaktight closure and equipped with a pressure gauge is associated with the hand pump, whereas a stopper not equipped with a pressure gauge or vent valve, but having a vent hole to allow air to enter the container, is associated with the electric pump.

* * * * *